United States Patent [19]

Boone

[11] 4,072,375

[45] Feb. 7, 1978

[54] DRAWER SLIDE ASSEMBLY WITH TAPERED RUNNER

[75] Inventor: Jack L. Boone, Algona, Iowa

[73] Assignee: Snap-on Tools Corporation, Kenosha, Wis.

[21] Appl. No.: 795,264

[22] Filed: May 9, 1977

[51] Int. Cl.[2] ..... A47B 88/00

[52] U.S. Cl. ..... 312/338; 308/3.6; 312/346

[58] Field of Search ..... 312/340, 350, 348, 333, 312/342, 345, 338, 343, 344, 346, 347; 308/3.6, 3.8

[56] References Cited

U.S. PATENT DOCUMENTS

| | | | |
|---|---|---|---|
| 2,277,702 | 3/1942 | Kennedy | 312/338 |
| 2,338,889 | 1/1944 | Yoxsimer | 312/346 |
| 3,393,951 | 7/1968 | Sulentic | 312/350 |
| 4,018,488 | 4/1977 | Manson | 312/343 |

*Primary Examiner*—Paul R. Gilliam
*Assistant Examiner*—A. Grosz
*Attorney, Agent, or Firm*—Vogel, Dithmar, Stotland, Stratman & Levy

[57] ABSTRACT

A drawer slide assembly for slidably mounting a drawer in a cabinet includes a pair of channel track members, each substantially C-shaped in transverse cross section, respectively secured to the adjacent side walls of the drawer and cabinet housing, each of said track members defining upper and lower channels respectively provided with longitudinally extending substantially flat planar parallel support surfaces. A runner is provided with a pair of laterally spaced apart upwardly extending arms respectively disposable in the upper channels of the track members and a pair of laterally spaced apart downwardly extending arms respectively disposable in the lower channels of the track members, each arm having a substantially flat planar bearing surface disposable in parallel sliding engagement with the associated one of the support surfaces. Each bearing surface has end portions inclined so as to diverge from the associated support surface toward the adjacent end thereof.

10 Claims, 5 Drawing Figures

DRAWER SLIDE ASSEMBLY WITH TAPERED RUNNER

BACKGROUND OF THE INVENTION

The present invention relates to sliding drawer cabinets and, more particularly, to slide assemblies for slidably mounting a drawer in a cabinet.

Typically, such slide assemblies include two track members respectively mounted on the cabinet side wall and the adjacent side of the drawer, the track members being interconnected by a floating runner. In such drawer slide assemblies which do not use roller wheels, ball bearings or the like, there has been a problem with the leading edges of the runner, which are generally sharp and angular, jamming or snagging in the associated track channels, which are generally arcuate in transverse cross section. This causes a tight or rough operation of the drawer and prevents a smooth sliding thereof between the open and closed positions.

SUMMARY OF THE INVENTION

In the present invention there is provided an improved drawer slide assembly comprising two channel track members interconnected by a runner, which is so designed as to prevent jamming or snagging and facilitate smooth sliding operation, thereby avoiding the difficulties of the prior art slide assemblies.

More particularly, it is an important feature of the present invention that the end portions of the runner are inclined away from the associated channel track surfaces so that the sharp angular end edges of the runner are out of contact with the channel tracks in use.

Another important feature of this invention is the provision of channel track members which are substantially C-shaped in transverse cross section with the upper and lower channels thereof being provided with flat planar support surfaces which are adapted to be disposed in use in parallel sliding engagement with complementary flat planar bearing surfaces on the runner.

These features are provided and it is a general object of this invention to attain these advantages by providing a drawer slide assembly for slidably mounting a drawer in a cabinet, the slide assembly comprising a first elongated track member adaptable to be mounted in use substantially horizontally on the inside of the associated cabinet and having a first elongated support portion, a second elongated track member adapted to be mounted in use substantially horizontally on the outside of the associated drawer and having a second elongated support portion, and an elongated runner having first and second support arms respectively extending laterally in opposite directions and respectively provided with longitudinally extending and substantially parallel lower and upper bearing surfaces, each of the lower and upper bearing surfaces having inclined portions terminating at end edges at the opposite ends thereof so that the inclined portions of the lower bearing surface respectively converge with the inclined portions of the upper bearing surface toward the adjacent ends thereof, the runner being disposed in use between the first and second track members with the lower bearing surface being supported upon the first support portion in longitudinal sliding engagement therewith and with the second support portion being supported upon the upper bearing surface in longitudinal sliding engagement therewith thereby slidably to support the associated drawer on the associated cabinet, whereby the end edges of the lower and upper bearing surfaces are disposed in use out of engagement with the first and second support portions thereby to prevent snagging thereof.

It is another object of this invention to provide a sliding drawer cabinet wherein the drawer is slidably mounted in the cabinet by means of a drawer slide assembly of the type set forth.

Further features of the invention pertain to the particular arrangement of the parts of the drawer slide assembly whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
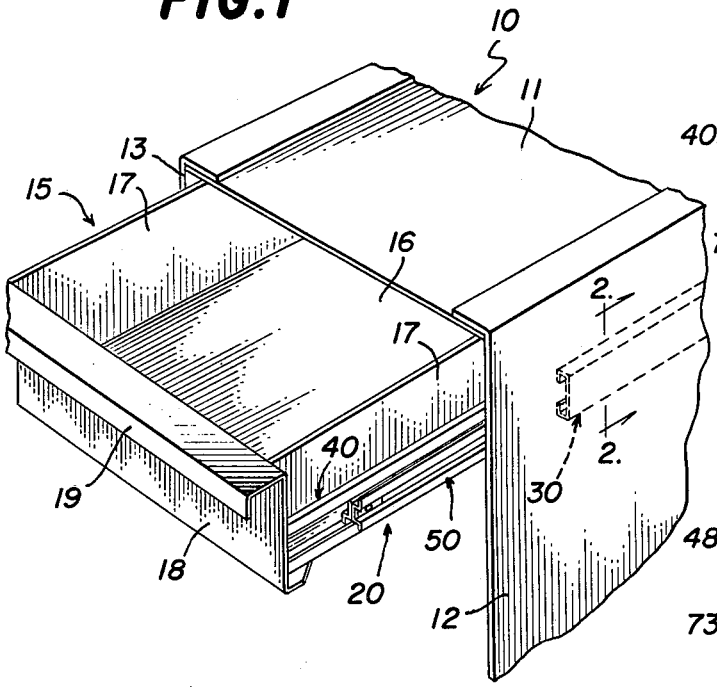
FIG. 1 is a fragmentary front perspective view of a sliding drawer cabinet utilizing a drawer slide assembly constructed in accordance with and embodying the features of the present invention.
Figure 2:
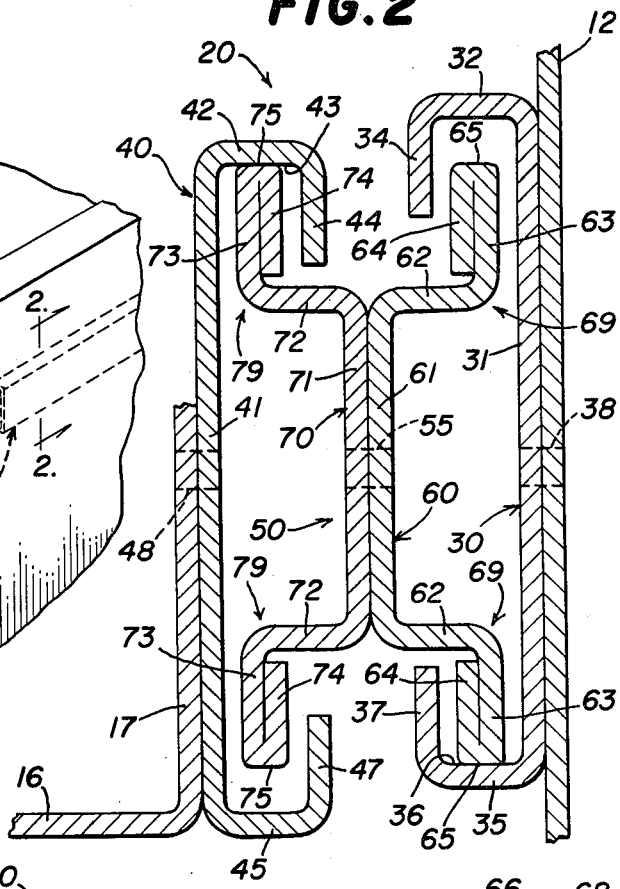
FIG. 2 is an enlarged fragmentary view in vertical section taken along the line 2—2 in FIG. 1.

Referring to FIG. 1 of the drawings, there is illustrated a cabinet, generally designated by the numeral 10, which includes a top wall 11 and a pair of opposed side walls 12 and 13, the cabinet 10 being of typical box-like construction and further including rear and bottom walls (not shown). Mounted in the open front of the cabinet 10 are one or more drawers (not shown), generally designated by the numeral 15, each drawer 15 having a bottom wall 16 and a pair of upstanding parallel side walls 17 interconnected at the front end thereof by a front wall 18 and the rear end thereof by a rear wall (not shown). Integral with the front wall 18 and projecting forwardly therefrom is a handle flange 19 to facilitate opening and closing of the drawer 15. The drawer 15 is slidably mounted on the cabinet side walls 12 and 13 by means of two identically constructed slide assemblies, each generally designated by the numeral 20, only one of which is seen in FIG. 1.

Referring now to FIGS. 2 through 5 of the drawings, each slide assembly 20 includes an elongated cabinet track member, generally designated by the numeral 30, which is substantially C-shaped in transverse cross section and includes a rectangular main wall 31 disposed in use in back-to-back engagement with the inner surface of the cabinet side wall 12 and is preferably fixedly secured thereto as by spot welds 38, although it will be appreciated that any other suitable fastening means could be utilized. Integral with the main wall 31 at the upper edge thereof along the entire length thereof is a laterally inwardly extending substantially horizontal support flange 32 integral at the inner edge thereof with a downwardly extending top retaining flange 34 disposed substantially parallel to the main wall 31. Integral with the main wall 31 at the lower edge thereof along the entire length thereof is a laterally inwardly extending substantially horizontal bottom support flange 35 provided with an inner flat planar support surface 36 disposed substantially horizontally in use. Integral with the support flange 35 at the inner edge thereof and extending vertically upwardly therefrom substantially parallel to the main wall 31 is a bottom retaining flange 37 which is disposed substantially in vertical alignment with the top retaining flange 34.

There is also provided a drawer track member, generally designated by the numeral 40, which is substantially identical in construction to the cabinet track member 30, the drawer track member 40 having a rectangular main wall 41 disposed in use in back-to-back engagement with the associated side wall 17 of the drawer 15 and preferably fixedly secured thereto as by spot welds 48. Integral with the main wall 41 at the upper edge thereof and extending laterally outwardly therefrom along the entire length thereof is a top support flange 42 provided with an inner flat planar support surface 43 which is disposed substantially horizontally in use. Integral with the inner edge of the top support flange 42 and extending vertically downwardly therefrom substantially parallel to the main wall 41 is a top retaining flange 44. Integral with the main wall 41 at the bottom edge thereof along the entire length thereof and extending laterally outwardly therefrom is a bottom support flange 45 which is integral at the outer edge thereof with a vertically upwardly extending bottom retaining flange 47 which is disposed substantially in vertical alignment with the top retaining flange 44.

The slide assembly 20 also includes an elongated runner, generally designated by the numeral 50, which is preferably formed of two substantially identically constructed parts, viz., an outer member 60 and an inner member 70 which are rigidly secured together as by spot welds 55. The outer member 60 includes an elongated rectangular body wall 61 which is integral at the upper and lower edges thereof with laterally outwardly extending substantially parallel flanges 62 which are in turn respectively integral at the outer edges thereof with vertical flanges 63 which respectively extend upwardly and downwardly from the corresponding ones of the lateral flanges 62. Each of the vertical flanges 63 has the distal edge portion 64 thereof folded back on itself with the outer surface of the bend or fold defining a substantially flat planar elongated bearing surface 65.

Figure 3:
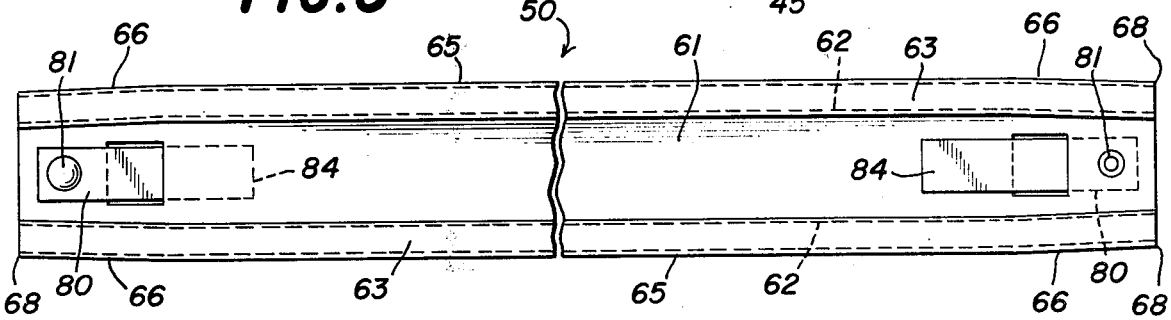
FIG. 3 is an enlarged side elevational view of the runner of the drawer slide assembly illustrated in FIG. 1, with a middle portion of the runner broken away.
Figure 4:
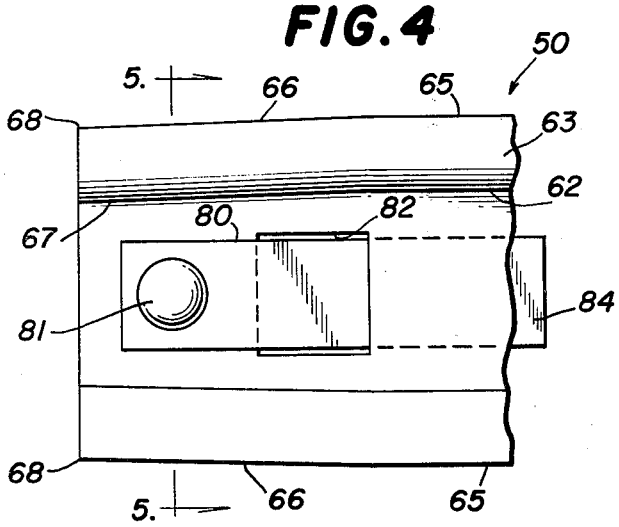
FIG. 4 is a further enlarged fragmentary side elevational view of the left-hand end of the runner of FIG. 3.
Figure 5:
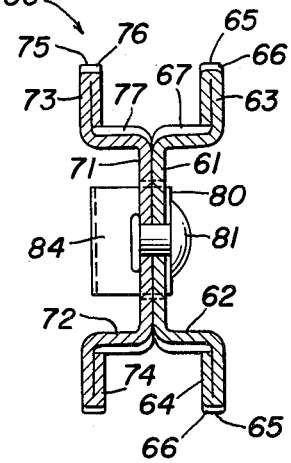
FIG. 5 is a view in vertical section taken along the line 5—5 in FIG. 4.

The flanges 62–63 define upper and lower arms 69, each of which has the opposite end portions thereof tapered or inclined inwardly, as by cold-roll forming, so that the upper and lower arms 69 converge toward the adjacent ends thereof, thereby to form inclined end portions 66 of the bearing surfaces 65 and inclined end portions 67 of the lateral flanges 62 (see FIGS. 3–5).

The inner member 70 includes an elongated rectangular body wall 71 which is integral at the upper and lower edges thereof with laterally outwardly extending substantially parallel flanges 72 which are in turn respectively integral at the outer edges thereof with vertical flanges 73 which respectively extend upwardly and downwardly from the corresponding ones of the lateral flanges 72. Each of the vertical flanges 73 has the distal edge portion 74 thereof folded back on itself with the outer surface of the bend or fold defining a substantially flat planar elongated bearing surface 75.

The flanges 72–73 define upper and lower arms 79, each of which has the opposite end portions thereof tapered or inclined inwardly, as by cold-roll forming, so that the upper and lower arms 79 converge toward the adjacent ends thereof, thereby to form inclined end portions 76 of the bearing surfaces 75 and inclined end portions 77 of the lateral flanges 72 (see FIG. 5).

The body walls 61 and 71 of the outer and inner members 60 and 70 are arranged in parallel back-to-back relationship and fixedly secured together by the spot welds 55 to form a rigid runner 50, with the upper and lower bearing surfaces 65 respectively coplanar with the upper and lower bearing surfaces 75. In use, the runner 50 is disposed between the cabinet track member 30 and the drawer track member 40, with the vertical flanges 63 respectively disposed in the upper and lower channels of the cabinet track member 30 and with the vertical flanges 73 respectively disposed in the upper and lower channels of the drawer track member 40. When thus arranged, the top and bottom retaining flanges 34 and 37 respectively cooperate with the vertical flanges 63 while the top and bottom retaining flanges 44 and 47 respectively cooperate with the vertical flanges 73 to limit movement of the runner 50 with respect to the track members 30 and 40 except in a longitudinal direction, thereby effectively to retain the drawer 15 in position with respect to the cabinet 10.

It will be appreciated that the weight of the drawer 15 will cause the support surface 43 of the drawer track member 40 to rest upon the upper bearing surface 75 of the runner 50 in sliding engagement therewith, which will in turn cause the lower bearing surface 65 of the runner 50 to rest upon the support surface 36 of the cabinet track member 30 in sliding engagement therewith for supporting the drawer 15 on the cabinet side wall 12, it being appreciated that the slide assembly 20 on the other side of the drawer 15 operates in the same manner to support the drawer 15 from the cabinet side wall 13. Because the support surfaces 36 and 43 of the track members 30 and 40 are flat planar surfaces which are wider than and substantially parallel to the bearing surfaces 65 and 75 of the runner 50, free sliding movement of the runner 50 and the track members 30 and 40 with respect to one another is accommodated.

Furthermore, the inclined end portions 66 and 76 of the bearing surfaces 65 and 75 are so inclined as to be disposed in use out of engagement with the associated support surfaces 36 and 43, whereby the end corners 68 of the outer member 60 and the corresponding end corners (not shown) of the inner member 70 do not engage the support surfaces 36 and 43 and, therefore, cannot catch or snag therealong. Rather, the initial bearing points of the bearing surfaces 65 are at the inner ends of the inclined end portions 66 and 76, which present relatively smooth surfaces to the support surfaces 36 and 43.

Preferably, the runner 50 is provided with a pair of stop fingers 80 formed of spring steel strips aligned longitudinally of the runner 50 and respectively having the outer ends thereof fixedly secured to the outer surfaces of the body walls 61 and 71 of the outer and inner members 60 and 70 as by rivets 81. The inners ends of the stop fingers 80 are respectively received through rectangular apertures 82 through the body walls 61 and 71 and project to the opposite sides of the runner 50, with the distal ends 84 of the stop fingers 80 extending a predetermined slight distance laterally outwardly from the runner 50 for cooperation with stop lugs (not shown) formed on the cabinet track member 30 and drawer track member 40 to limit the sliding longitudinal movement of the track members 30 and 40 and the runner 50 with respect to one another to prevent accidental removal of the drawer 15 from the slide assembly 20 when opening the drawer 15, all in a well-known manner.

Preferably, the slide assembly 20 is formed of sheet metal such as steel, but it will be appreciated that any other suitable material could be utilized. Furthermore, while the runner 50 has been disclosed as formed of two separate members 60 and 70 riveted together, it will be understood that the runner 50 could be integrally formed of a single piece of material.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A drawer slide assembly for slidably mounting a drawer in a cabinet, said slide assembly comprising a first elongated track member adapted to be mounted in use substantially horizontally on the inside of the associated cabinet and having a first elongated support portion, a second elongated track member adapted to be mounted in use substantially horizontally on the outside of the associated drawer and having a second elongated support portion, and an elongated runner having first and second support arms respectively extending laterally in opposite directions and respectively provided with longitudinally extending and substantially parallel lower and upper bearing surfaces, each of said lower and upper bearing surfaces having inclined end portions terminating at end corners at the opposite ends thereof so that said inclined end portions of said lower bearing surface respectively converge with said inclined end portions of said upper bearing surface toward the adjacent ends thereof, said runner being disposed in use between said first and second track members with said lower bearing surface being supported upon said first support portion in longitudinal sliding engagement therewith and with said second support portion being supported upon said upper bearing surface in longitudinally sliding engagement therewith thereby slidably to support the associated drawer on the associated cabinet, whereby said end corners of said lower and upper bearing surfaces are disposed in use out of engagement with said first and second support portions thereby to prevent snagging thereof.

2. The drawer slide assembly set forth in claim 1, wherein said runner comprises two members fixedly secured together and respectively carrying said first and second support arms.

3. The drawer slide assembly set forth in claim 1, and further including retaining means carried by said first and second track members for cooperation with said first and second support arms effectively to limit movement of said runner and said track members with respect to one another except longitudinally thereof.

4. The drawer slide assembly set forth in claim 1, wherein each of said first and second track members is generally C-shaped in transverse cross section and defines upper and lower longitudinally extending channels, said runner having a pair of said first support arms respectively disposed in use in the upper and lower channels of said first track member and a pair of said second support arms respectively disposed in use in the upper and lower channels of said second track member, said support arms respectively cooperating with said channels effectively to limit movement of said runner and said track members with respect to one another except longitudinally thereof.

5. The drawer slide assembly set forth in claim 1, wherein each of said first and second support arms has tapered portions at the opposite ends thereof, said inclined portions of said upper and lower bearing surfaces being respectively formed on said tapered portions of said second and first support arms.

6. The drawer slide assembly set forth in claim 1, and further including stop means carried by said runner and said first and second track members for limiting longitudinal movement thereof with respect to one another in the opening direction of the associated drawer.

7. A drawer slide assembly for slidably mounting a drawer in a cabinet, said slide assembly comprising a first elongated track member adapted to be mounted in use substantially horizontally on the inside of the associated cabinet and having a first elongated substantially flat planar support surface, a second elongated track member adapted to be mounted in use substantially horizontally on the outside of the associated drawer and having a second elongated substantially flat planar support surface, and an elongated runner having first and second support arms respectively extending in opposite directions therefrom, said first support arm having a lateral flange and a vertical flange extending from said lateral flange substantially normal thereto and provided with a longitudinally extending substantially flat planar lower bearing surface, said second support arm having a lateral flange and a vertical flange extending from said lateral flange substantially normal thereto and provided with a longitudinally extending substantially flat planar upper bearing surface, each of said lower and upper bearing surfaces having inclined end portions terminating at end corners at the opposite ends thereof so that said inclined end portions of said lower bearing surface respectively converge with said inclined end portions of said upper bearing surface toward the adjacent ends thereof, said runner being disposed in use between said first and second track members with said lower bearing surface being supported upon said first support surface parallel thereto and in longitudinal sliding engagement therewith and with said second support surface being supported upon said upper bearing surface parallel thereto and in longitudinal sliding engagement therewith thereby slidably to support the associated drawer on the associated cabinet, whereby said end corners of said lower and upper bearing surfaces are disposed in use out of engagement with said first and second support surfaces thereby to prevent snagging thereof.

8. The drawer slide assembly set forth in claim 7, wherein said first and second track members respectively include retaining flanges respectively extending from said first and second support surfaces substantially normal thereto along substantially the entire length thereof for cooperation respectively with said first and second support arms effectively to limit movement of said first and second track members and said runner with respect to one another except longitudinally thereof.

9. The drawer slide assembly set forth in claim 7, wherein each of said first and second track members is generally C-shaped in transverse cross section and defines upper and lower longitudinally extending channels, said runner having a pair of said first support arms respectively disposed in use in the upper and lower channels of said first track member and a pair of said second support arms respectively disposed in use in the upper and lower channels of said second track member, said support arms respectively cooperating with said channels effectively to limit movement of said runner and said track members with respect to one another except longitudinally thereof.

10. A sliding drawer cabinet comprising: a generally rectangular open-front housing having a pair of opposed upstanding side walls; a drawer dimensioned to be received in the open front of said housing; and two drawer slide assemblies respectively disposed for slidably connecting the opposite sides of said drawer to the adjacent side walls of said housing; each of said slide assemblies including a first elongated track member mounted substantially horizontally on the inner surface of the associated one of said cabinet side walls and having a first elongated support portion, a second elongated track member mounted substantially horizontally on the adjacent side of said drawer and having a second elongated support portion, and an elongated runner having first and second support arms respectively extending laterally in opposite directions and respectively provided with longitudinally extending and substantially parallel lower and upper bearing surfaces, each of said lower and upper bearing surfaces having inclined end portions terminating at end corners at the opposite ends thereof so that said inclined end portions of said lower bearing surface respectively converge with said inclined end portions of said upper bearing surface toward the adjacent ends thereof, said runner being disposed in use between said first and second track members with said lower bearing surface being supported upon said first support portion in longitudinal sliding engagement therewith and with said second support portion being supported upon said upper bearing surface in longitudinal sliding engagement therewith thereby slidably to support said drawer on said cabinet side walls; whereby said end corners of said lower and upper bearing surfaces are disposed in use out of engagement with said first and second support portions thereby to prevent snagging thereof.

* * * * *